US012000124B2

(12) United States Patent
Uttamchandani

(10) Patent No.: US 12,000,124 B2
(45) Date of Patent: Jun. 4, 2024

(54) THERMOCHROMIC PLUMBING FIXTURE DEVICE

(71) Applicant: Sachin Uttamchandani, Miami, FL (US)

(72) Inventor: Sachin Uttamchandani, Miami, FL (US)

( * ) Notice: Subject to any disclaimer, the term of this patent is extended or adjusted under 35 U.S.C. 154(b) by 53 days.

(21) Appl. No.: 17/893,229

(22) Filed: Aug. 23, 2022

(65) Prior Publication Data

US 2023/0133907 A1 May 4, 2023

Related U.S. Application Data

(60) Provisional application No. 63/275,683, filed on Nov. 4, 2021.

(51) Int. Cl.
*E03C 1/04* (2006.01)

(52) U.S. Cl.
CPC ..... *E03C 1/0408* (2013.01); *E03C 1/0404* (2013.01); *E03C 2001/0418* (2013.01)

(58) Field of Classification Search
CPC ..... E03C 1/0408; E03C 1/0404; E03C 2001/0418
USPC ..... 4/596
See application file for complete search history.

(56) References Cited

U.S. PATENT DOCUMENTS

2012/0060945 A1* 3/2012 Lee ..... B05B 1/22 29/428
2013/0269799 A1* 10/2013 Swist ..... E03C 1/041 137/551
2017/0356172 A1* 12/2017 Searcy ..... E03C 1/0408
2019/0153709 A1* 5/2019 Granstrand ..... G01K 11/12

* cited by examiner

*Primary Examiner* — Huyen D Le
(74) *Attorney, Agent, or Firm* — Brennan, Manna & Diamond, LLC

(57) ABSTRACT

The present invention relates generally to a thermochromic plumbing fixture device that is fastened with an indicator strip, which changes color depending on the temperature of the water exiting the fixture. The plumbing fixture may be any plumbing fixture known in the art but is preferably a faucet and/or a showerhead. Different embodiments may feature multiple indicator strips or may be finished with a thermochromic coating. In this manner, the device, or portions of the device, may change color as the temperature of the water heats up the thermochromic coating, which results in a user obtaining information about the water's temperature.

20 Claims, 2 Drawing Sheets

THERMOCHROMIC PLUMBING FIXTURE DEVICE

CROSS-REFERENCE TO RELATED APPLICATION

The present application claims priority to, and the benefit of, U.S. Provisional Application No. 63/275,683, which was filed on Nov. 4, 2021 and is incorporated herein by reference in its entirety.

FIELD OF THE INVENTION

The present invention relates generally to the field of plumbing fixtures. More specifically, the present invention relates to a thermochromic plumbing fixture device that is fastened with an indicator strip which changes color depending on the temperature of the water within the fixture. The plumbing fixture may be any plumbing fixture known in the art, but is preferably a faucet and/or a showerhead. The device, or portions of the device, may change color as the temperature of the water within the fixture heats up the thermochromic coating, which results in a user obtaining information about the water's temperature. Accordingly, the present disclosure makes specific reference thereto. Nonetheless, it is to be appreciated that aspects of the present invention are also equally applicable to other like applications, devices and methods of manufacture.

BACKGROUND

Running water is used in almost every household and is essential for a plurality of functions, such as bathing, washing dishes or simply procuring a glass of water. However, many of these activities require the water to be set at a high temperature. With most existing plumbing fixtures, there is no indication of the temperature of the water. Therefore, to determine if the water is at an optimal temperature, a person must reach his or her hand underneath the stream of water and feel the water directly. Sometimes, the water is too cold and may cause a sharp uncomfortable pain in the person's hand. In other instances, the water is too hot and may severely burn the person. Regardless, unless the temperature is correct on the first test, it is likely that the person may experience discomfort when he or she attempts to test the water temperature to achieve the desired temperature.

Therefore, there exists a long-felt need in the art for a thermochromic plumbing fixture device that changes color depending on the temperature of the water. There also exists a long-felt need in the art for a device that removes the necessary step of running your hand under the water to determine the temperature of the water. In addition, there exists a long felt need in the art for thermochromic properties to be applied to plumbing fixtures. Lastly, there exists a long-felt need in the art for a thermochromic plumbing fixture device made from durable materials.

The subject matter disclosed and claimed herein, in one embodiment thereof, comprises a thermochromic plumbing fixture device. The device is comprised of a plumbing fixture that is fastened with an indicator strip, which changes color depending on the temperature of the water within and the water that exits the plumbing fixture. The indicator strip is covered with a thermochromic coating, which can be engineered to display different colors for a different range of water temperatures. The plumbing fixture is preferably a plumbing fixture where determining the temperature of the water is of high importance such as, but not limited to, a faucet or a showerhead.

In this manner, the thermochromic plumbing fixture device of the present invention accomplishes all of the forgoing objectives and provides information about the temperature of the water based on the color of the indicator strip. Moreover, the device offers the user valuable information about different water temperatures, such that the user can obtain the optimal water temperature without the need to make contact with the water. In this manner, a user is made safer and is put at less risk of discomfort or pain when attempting to determine water temperature.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a thermochromic plumbing fixture device. The device is comprised of a plumbing fixture with an indicator strip, which features a thermochromic coating. In this manner, the indicator strip may change color as it interacts with water of different temperatures that exits the plumbing fixture. This may allow a user to ascertain the temperature of the water without having to risk burning his or her hands. The plumbing fixture is preferably manufactured of stainless steel. Other embodiments may be manufactured from other suitable metal materials as are known in the art. The plumbing fixture may be any plumbing fixture known in the art. However, in two preferred embodiments, the plumbing fixture is a faucet and/or a showerhead.

The faucet fixture is preferably a cartridge faucet but may be any faucet known in the art. The showerhead fixture is preferably a fixed showerhead but may be any showerhead known in the art. Both the faucet fixture and showerhead fixture are preferably made of a stainless-steel material, but may be comprised of any other suitable metal material known in the art. In the preferred model, at least one indicator strip is fastened to the spout of a faucet fixture and the body of a showerhead fixture. The indicator strip may be fastened to any portion of both the faucet and the showerhead. Further, instead of the indicator strip, a thermochromic coating may be directly applied to a device's components in other embodiments.

Accordingly, the thermochromic plumbing fixture device of the present invention is particularly advantageous as it gives the user the ability to determine if the water temperature is optimal, without causing risk of injury by a user putting his or her hands under hot water. Moreover, the temperature-changing colors can be fixed to a multitude of devices, such that a user can utilize this feature in many different situations. In this manner, the thermochromic plumbing fixture device overcomes the limitations of existing plumbing fixtures known in the art.

To the accomplishment of the foregoing and related ends, certain illustrative aspects of the disclosed innovation are described herein in connection with the following description and the annexed drawings. These aspects are indicative however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
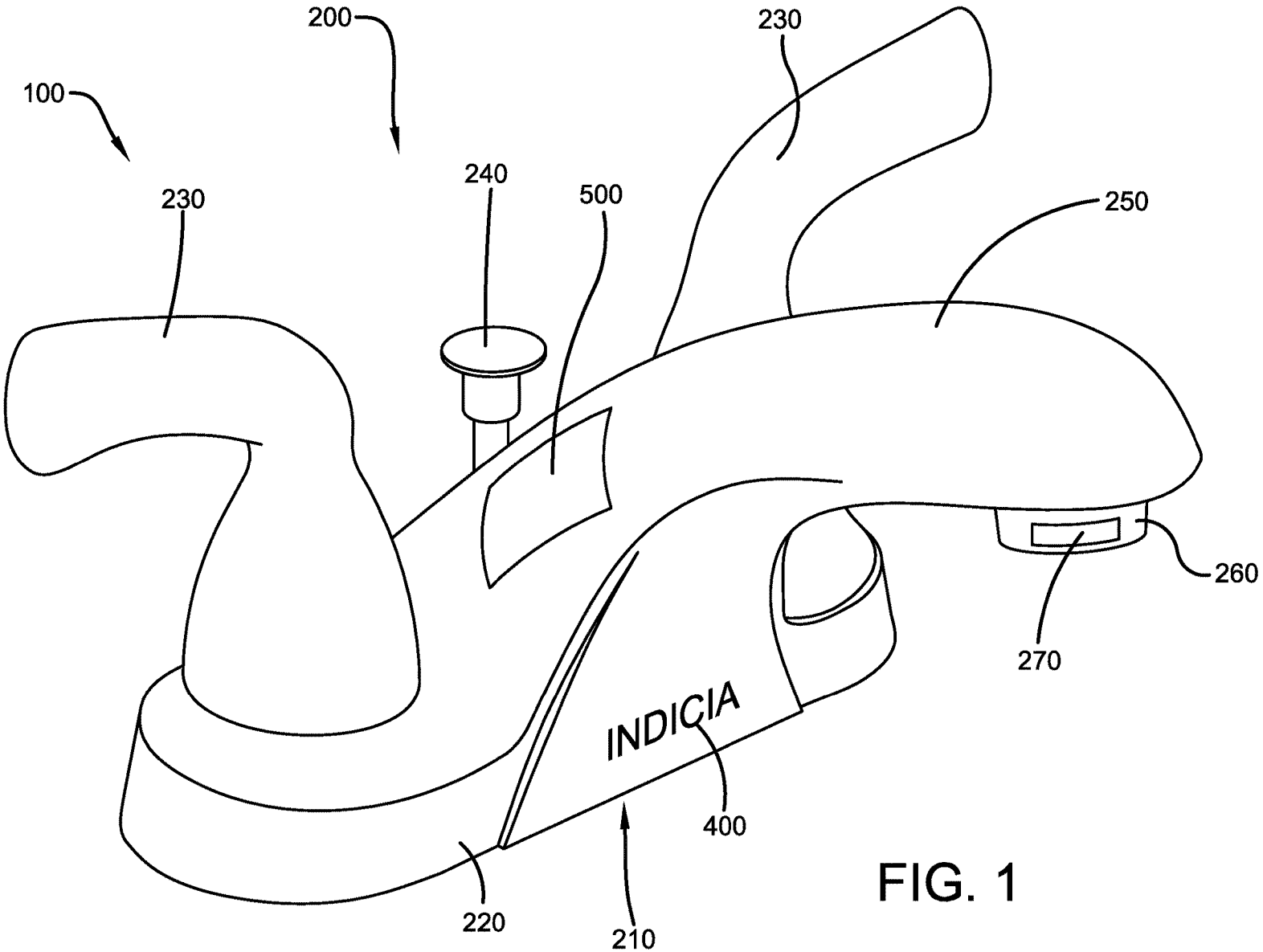
FIG. 1 illustrates a perspective view of one potential embodiment of the thermochromic plumbing fixture device of the present invention in the form of a faucet in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there exists a long-felt need in the art for a thermochromic plumbing fixture device, wherein changing colors may inform a user as to what the water temperature is for water flowing from the fixture. Accordingly, there exists a long-felt need in the art for a device which replaces the need for a user to stick his or her hand in hot water to ascertain its temperature. There also exists a long felt need in the art for thermochromic properties to be applied to both a faucet and a showerhead. Lastly, there exists a long-felt need in the art for a thermochromic plumbing fixture device that is durable and can withstand long-lasting use.

The present invention, in one exemplary embodiment, comprises a thermochromic plumbing fixture device. The device is comprised of a plumbing fixture with an indicator strip, which features a thermochromic coating. In this manner, the indicator strip may change color as the plumbing fixture changes in temperature, due to the water within the fixture. The information that the indicator strip provides allows a user to refrain from running his or her hands under potentially hot water. The plumbing fixture is preferably made of stainless steel, but may be made of any suitable metal material known in the art. Embodiments of the plumbing fixture may be any suitable plumbing fixture known in the art, but a preferred embodiment comprises a faucet and/or a showerhead.

The preferred faucet fixture is a cartridge faucet but may be any faucet known in the art. The preferred embodiment of the showerhead fixture is a fixed showerhead, but may be any showerhead known in the art. The faucet fixture and showerhead fixture are preferably made of a stainless-steel material, but may be manufactured from any other suitable metal material known in the art. At least one indicator strip is preferably fastened to the spout of a faucet fixture and the body of a showerhead fixture. Further, both the faucet and the showerhead may feature an indicator strip on any component of the device. In other embodiments, a thermochromic coating may be directly applied to the device's components instead of the indicator strip.

Referring initially to the drawings, FIG. 1 illustrates a perspective view of one embodiment of the thermochromic plumbing fixture device 100 of the present invention in the form of a faucet 200. The device 100 is preferably comprised of a plumbing fixture such as, but not limited to, a faucet 200 and/or a showerhead 300 (shown in FIG. 2), wherein the fixture may have at least one indicator strip 270, 360 (shown on the showerhead 300) that changes color in response to a change in temperature of the fixture 100, based on the temperature of the water within and/or exiting the fixture. However, it should be noted that the device 100 may be any suitable plumbing fixture as is known in the art and is not limited to a faucet 200 and/or a showerhead 300.

The faucet 200 may be any suitable faucet 200 as is known in the art such as, but not limited to, ball faucets, compression water faucets, cartridge faucets, disc faucets, etc. The faucet 200 components include the components of a conventional faucet such as, but not limited to, a body 210, escutcheon plate 220, handles 230, stopper 240, spout 250 and aerator 260. The faucet 200 components are also preferably manufactured from a stainless steel material, but can be also manufactured from a plurality of different metals such as, but not limited to, aluminum, copper, brass, bronze, zinc, titanium, carbon steel, alloyed steel, tungsten, nickel, cobalt, tin, silicon, etc., or any other suitable material as is known in the art. Higher end versions of the device 100 may be manufactured from precious metals such as, but not limited to, gold, silver, palladium, iridium, rhenium, ruthenium, rhodium, osmium, platinum, etc., or any other suitable precious metals as are known in the art. To enhance the appearance of the device 100, an escutcheon plate 220 conceals the gap around the base of the faucet 200 and the opening of a sink or countertop that receives the faucet 200.

Furthermore, the faucet 200 is controlled through the use of at least one handle 230, which allows a user to turn the faucet 200 on/off and also allows a user to change the temperature of the water that exits the faucet 200 from hot to cold and vice versa. The handle 230 is preferably connected to a cartridge, which in turn is connected to a valve that controls access to the water. Turning the handle 230 turns the cartridge within the valve to release water, which travels through the faucet 200 and out of the spout 250. At this point, the body 210 heats or cools at least one indicator strip 270, which then reacts to the temperature of the water within the faucet 200 and changes color. Additionally, the aerator 260 is preferably comprised of a small mesh screen. Thus, the aerator 260 adds air in the stream by breaking up the flow of water into multiple smaller streams. Further, the device 100 may feature a stopper 240 that is connected to the drain in the sink. The stopper 240 may be pulled upwards to close the drain or pushed down to open the drain.

Additionally, the at least one indicator strip 270 is preferably coated with a thermochromic paint such as, but not limited to, leuco dyes or thermochromic liquid crystals, etc., or any other suitable dyes as are known in the art. Accordingly, the indicator strip 270 may have heat-sensitive properties, whereby its interaction with the body 210 and the changing temperature of the body 210, due to the changing temperature of the water within the body 210, causes the pigments of the indicator strip 270 to change in color. In one embodiment, the indicator strip 270 may turn from a first color, such as but not limited to black, to a second color, such as but not limited to red, once the temperature of the water passing through the body 210 reaches 88 degrees Fahrenheit.

Other embodiments of the device 100 may feature an indictor strip 270, that is coated with multiple thermochromic inks, which may be engineered to react at different temperature ranges. For example, one embodiment may display a first color, such as but not limited to a blue coloring, if the water temperature passing through the body 210 is below 60 degrees Fahrenheit, and display a second color, such as but not limited to a yellow coloring, if the water temperature of the water passing through the body 210 is between 61 and 80 degrees Fahrenheit. Further, one embodiment may display a third color, such as but not limited to an orange coloring, if the water temperature passing through the body 210 is between 81 and 100 degrees Fahrenheit. Finally, one embodiment may display a fourth color, such as but not limited to a red coloring, if the water temperature passing through the body 210 is over 100 degrees Fahrenheit. Accordingly, the indicator strip 270 may display any suitable color known in the art and may be engineered to react at any temperature range as is known in the art.

Further, the indictor strip 270 may be fastened to or be integrally-manufactured within any part of the faucet 200 as an embedded structure, removable adhesive structure and/or coating. In differing embodiments, a thermochromic coating 500 may be applied to different areas of the faucet 200 instead of or in addition to the indicator strip 270. In one embodiment, the thermochromic coating may be applied to each component of the faucet 200, whereby the entire faucet 200 may change color depending on the temperature of the water, as described supra. Thermochromic coatings may be applied in a way as to show a plurality of color-changing decorative indicia 400, such as patterns, logos, emblems, images, symbols, designs, letters, words, characters, animals, advertisements, brands, etc., or any other suitable indicia as is known in the art. One embodiment may feature a thermochromic coating applied to the body 210 in the shape of a flame or other suitable symbol or design, whereby the flame is not visible until the device 100 reaches a certain temperature and the thermochromic coating changes color to reveal the indicia 400.

Figure 2:
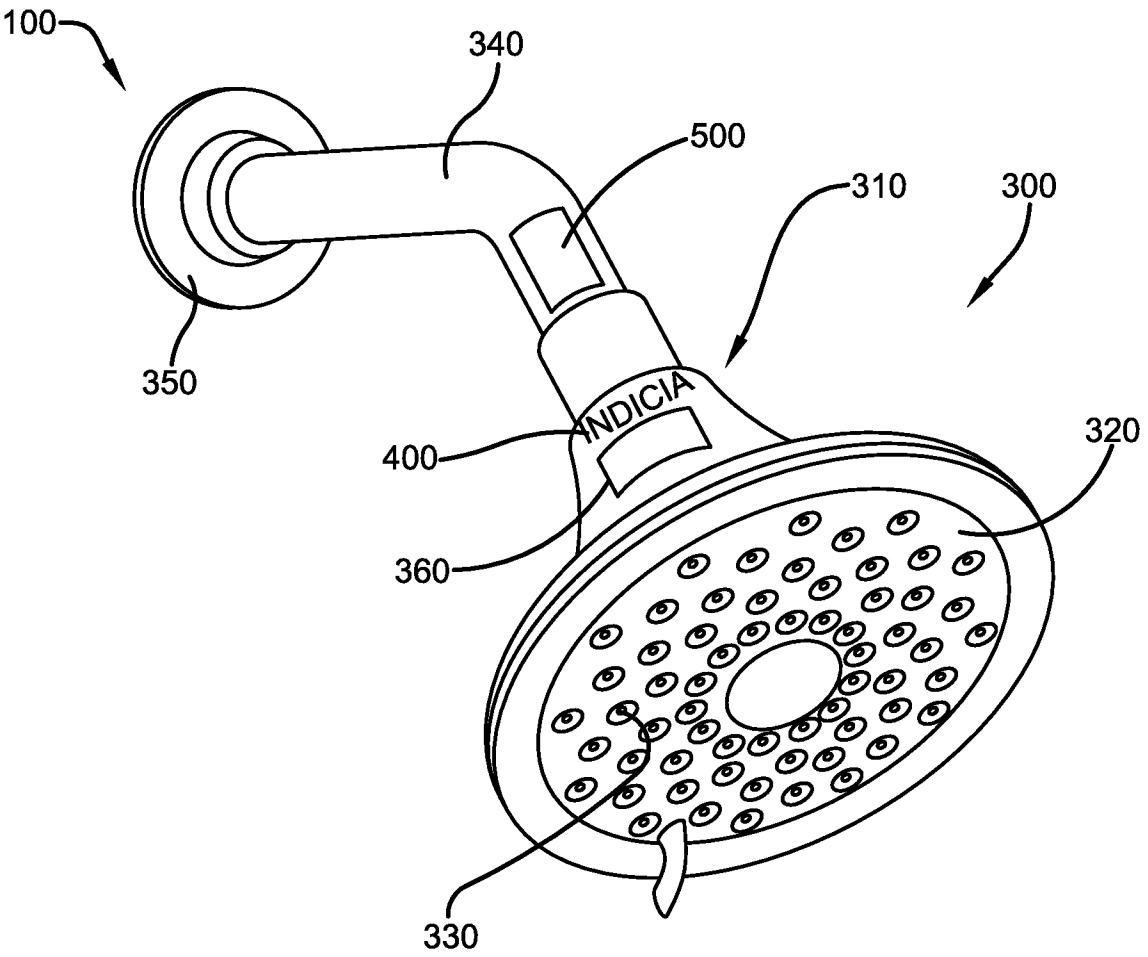
FIG. 2 illustrates a perspective view of one potential embodiment of the thermochromic plumbing fixture device of the present invention in the form of a showerhead in accordance with the disclosed architecture.

FIG. 2 illustrates a perspective view of one embodiment of the thermochromic plumbing fixture device 100 of the present invention in the form of a showerhead 300. The showerhead 300 may be any suitable showerhead 300 as is known in the art such as, but not limited to, fixed, handheld, dual, filtered, waterfall, massage, high-pressure, low flow, panel, etc. The showerhead 300 components include the components of a conventional showerhead 300 such as, but not limited to, a body 310, stem 340, and escutcheon plate 350. The showerhead 300 components are also preferably manufactured from stainless steel, but can be manufactured from a plurality of different metals, such as but not limited to: aluminum, copper, brass, bronze, zinc, titanium, carbon steel, alloyed steel, tungsten, nickel, cobalt, tin, silicon, etc., or any other suitable materials as are known in the art. Furthermore, higher end versions of the device 100 may be manufactured from precious metals such as, but not limited to, gold, silver, palladium, iridium, rhenium, ruthenium, rhodium, osmium, platinum, etc., or any other suitable precious metals as are known in the art. To enhance the appearance of the device 100, an escutcheon plate 350 conceals the gap around the base of the showerhead 300.

The showerhead 300 features a plurality of continuous openings 330 on its bottom surface 320 that allow water to flow outwards from the surface 320. Water flows into the device 100 beginning in the stem 340, through the body 310 and out of the continuous openings 330. In one embodiment, water will come into contact with an indicator strip 360 on the body 310.

Furthermore, the showerhead 300 features at least one indicator strip 360, which is preferably coated with a thermochromic paint such as, but not limited to, leuco dyes or thermochromic liquid crystals, etc., or any other suitable dyes as are known in the art. Thus, the indicator strip 360 may demonstrate heat-sensitive properties, such that its interaction with the changing temperature of the body 310 caused by the changing temperature of the water within the body 310 causes the pigments of the indicator strip 360 to alter in color. In one embodiment, the indicator strip 360 may turn from a first color, such as but not limited to black, to a second color, such as but not limited to red, once the temperature of the water passing through the body 310 reaches 88 degrees Fahrenheit.

Other embodiments of the device 100 may feature an indictor strip 360 that is coated with multiple thermochromic inks, which may be engineered to react at different temperature ranges. For example, one embodiment may display a first color, such as but not limited to a blue coloring, if the water temperature passing through the body 310 is below 60 degrees Fahrenheit, and display a second color, such as but not limited to a yellow coloring, if the water temperature passing through the body 310 is between 61 and 80 degrees Fahrenheit. Another embodiment may display a third color, such as but not limited to an orange coloring, if the water temperature of the water passing through the body 310 is between 81 and 100 degrees Fahrenheit, and display a fourth color, such as but not limited to a red coloring, if the water temperature is over 100 degrees Fahrenheit. Accordingly, the indicator strip 360 may display any suitable color known in the art and be engineered to react at any temperature range.

An indictor strip 360 may be fastened to any part of the showerhead 300 as an embedded structure, removable adhesive structure, and/or coating. In different embodiments, a thermochromic coating 500, instead of or in addition to an indicator strip 360, may be applied to different areas of the showerhead 300. In one embodiment, the thermochromic coating may be applied to each component of the showerhead 300 and may change color depending on the temperature of the water. Thermochromic coatings may be applied in a way as to show a plurality of color-changing decorative indicia 400, such as patterns, logos, emblems, images, symbols, designs, letters, words, characters, animals, advertisements, brands, etc., or any other suitable indicia as is known in the art. One embodiment may feature a thermochromic coating applied to the body 310 in the shape of a flame or other suitable symbol or design, wherein the flame is not visible until the device 100 reaches a certain temperature and the thermochromic coating changes color to reveal the indicia 400.

It should be appreciated that as noted above, the device 100 can be any suitable plumbing fixture as is known in the art in differing embodiments. Accordingly, the faucet 200 and showerhead 300 have only been shown and described to illustrate and explain only two of numerous potential embodiments of differing types of plumbing fixtures to which the overall concept of the device 100 can be applied.

Said fixtures may also include, but are not limited to, hoses, kitchen sinks, taps, drinking fountains, etc., or any other suitable type of residential, commercial, or industrial plumbing fixture that expels water as is known in the art. In a differing embodiment, the device 100 may be a commercial hydronic/gas fitting. Furthermore, the indicator strip 270, 360 may be present on, within, or partially embedded within any surface, structure or component of the faucet 200 and/or showerhead 300. The same is also true for differing embodiments of the device 100, comprised of a different plumbing fixture. Furthermore, the coating of the indicator strip 270, 360 may be a stand-alone adhesive-backed device that can be applied retroactively to existing plumbing fixtures. The indicator strip 270, 360 may also cover the entire plumbing fixture in the form of a coating.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "thermochromic plumbing fixture device" and "device" are interchangeable and refer to the thermochromic plumbing fixture device 100 of the present invention.

Notwithstanding the forgoing, the thermochromic plumbing fixture device 100 of the present invention and its various components can be of any suitable size and configuration as is known in the art without affecting the overall concept of the invention, provided that they accomplish the above-stated objectives. One of ordinary skill in the art will appreciate that the size, configuration and material of the thermochromic plumbing fixture device 100 as shown in FIGS. 1-2 is for illustrative purposes only, and that many other sizes and shapes of the thermochromic plumbing fixture device 100 are well within the scope of the present disclosure. Although the dimensions of the thermochromic plumbing fixture device 100 are important design parameters for user convenience, the thermochromic plumbing fixture device 100 may be of any size, shape and/or configuration that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A thermochromic plumbing fixture device further comprised of:

a plumbing fixture; and at least one indicator strip comprising an adhesive backing; and wherein the at least one indicator strip is coated with a plurality of thermochromic elements, each thermochromic element configured to react to a different temperature range from the other thermochromic elements and causes the at least one indicator strip to change color based on a temperature of a water passing through the plumbing fixture, wherein the at least one indicator strip is adhesively applied to the plumbing fixture.

2. The thermochromic plumbing fixture device of claim 1, wherein the at least one indicator strip is located on a body of the plumbing fixture.

3. The thermochromic plumbing fixture device of claim 1, wherein the at least one indicator strip changes from a first color to a second color when the temperature of the water within the plumbing fixture reaches 88 degrees Fahrenheit.

4. The thermochromic plumbing fixture device of claim 1, wherein the at least one indicator strip displays a first color if the temperature of the water passing through the plumbing fixture is below 60 degrees Fahrenheit, and displays a second color if the temperature of the water passing through the plumbing fixture is between 61 and 80 degrees Fahrenheit, and displays a third color if the temperature of the water passing through the plumbing fixture is between 81 and 100 degrees Fahrenheit, and displays a fourth color if the temperature of the water passing through the plumbing fixture is above 100 degrees Fahrenheit.

5. The thermochromic plumbing fixture device of claim 1, wherein the plumbing fixture is a showerhead.

6. The thermochromic plumbing fixture device of claim 1, wherein the at least one indicator strip comprises a decorative indicia.

7. The thermochromic plumbing fixture device of claim 1, wherein the plumbing fixture is a faucet.

8. A thermochromic plumbing fixture device further comprised of:

a plumbing fixture comprising an escutcheon plate, a pair of handles, a spout, a stopper, and a meshed aerator; and at least one coating of a thermochromic paint that has heat-sensitive properties that causes the at least one coating to change color based on a temperature of a water passing through the plumbing fixture, wherein the at least one coating can be applied to any component of the plumbing fixture; and at least one indicator strip embedded within the plumbing fixture and comprising a plurality of thermochromic elements, each thermochromic element configured to react to a different temperature range from the other thermochromic elements and cause the at least one indicator strip to change color based on a temperature of a water passing through the plumbing fixture.

9. The thermochromic plumbing fixture device of claim 8, wherein the at least one coating is located on a body of the plumbing fixture.

10. The thermochromic plumbing fixture device of claim 9, wherein the at least one coating changes from a first color to a second color when the temperature of the water within the plumbing fixture reaches 88 degrees Fahrenheit.

11. The thermochromic plumbing fixture device of claim 9, wherein the at least one coating displays a first color if the temperature of the water passing through the plumbing fixture is below 60 degrees Fahrenheit, displays a second color if the temperature of the water passing through the plumbing fixture is between 61 and 80 degrees Fahrenheit, displays a third color if the temperature of the water passing through the plumbing fixture is between 81 and 100 degrees Fahrenheit, and displays a fourth color if the temperature of the water passing through the plumbing fixture is above 100 degrees Fahrenheit.

12. The thermochromic plumbing fixture device of claim 8, wherein the plumbing fixture is either a faucet or a showerhead.

13. The thermochromic plumbing fixture device of claim 8, wherein the at least one coating further comprises a decorative indicia.

14. The thermochromic plumbing fixture device of claim 13, wherein the decorative indicia resembles a flame.

15. A thermochromic plumbing fixture device further comprised of:

a plumbing fixture;

at least one coating of a thermochromic paint that has heat-sensitive properties that causes the at least one coating to change color based on a temperature of a water passing through the plumbing fixture, wherein the at least one coating can be applied to any component of the plumbing fixture; and at least one indicator strip comprising an adhesive backing and a plurality of thermochromic elements, each thermochromic element configured to react to a different temperature range from the other thermochromic elements and cause the at least one indicator strip to change color based on a temperature of a water passing through the plumbing fixture, wherein the at least one indicator strip is adhesively applied to the plumbing fixture; and a plurality of color-changing symbol indicia for indicating specific temperatures.

16. The thermochromic plumbing fixture device of claim 15, wherein the at least one indicator strip is located on a body of the plumbing fixture.

17. The thermochromic plumbing fixture device of claim 16, wherein the at least one indicator strip changes from a first color to a second color when the temperature of the water within the plumbing fixture reaches 88 degrees Fahrenheit.

18. The thermochromic plumbing fixture device of claim 16, wherein the at least one indicator strip displays a first color if the temperature of the water passing through the plumbing fixture is below 60 degrees Fahrenheit, displays a second color if the temperature of the water passing through the plumbing fixture is between 61 and 80 degrees Fahrenheit, displays a third color if the temperature of the water passing through the plumbing fixture is between 81 and 100 degrees Fahrenheit, and a fourth color if the temperature of the water passing through the plumbing fixture is above 100 degrees Fahrenheit.

19. The thermochromic plumbing fixture device of claim 15, wherein the plumbing fixture is a faucet.

20. The thermochromic plumbing fixture device of claim 19, wherein the plumbing fixture is a showerhead.

* * * * *